United States Patent [19]

Towsley

[11] 4,121,992

[45] Oct. 24, 1978

[54] ELECTROLYTIC CELL

[75] Inventor: Frank E. Towsley, Midland, Mich.

[73] Assignee: The Dow Chemical Company, Midland, Mich.

[21] Appl. No.: 841,179

[22] Filed: Oct. 11, 1977

Related U.S. Application Data

[63] Continuation-in-part of Ser. No. 691,692, Jun. 1, 1976, Pat. No. 4,053,371.

[51] Int. Cl.[2] ..... C25B 1/16; C25B 11/03

[52] U.S. Cl. ..... 204/265; 204/20; 204/266

[58] Field of Search ..... 204/265, 266, 277, 98, 204/11, 20, 23, 24, 26

[56] References Cited

U.S. PATENT DOCUMENTS

| | | | |
|---|---|---|---|
| 2,578,167 | 12/1951 | Bjorklund et al. | 204/16 |
| 2,681,884 | 6/1954 | Butler, Jr. | 204/98 |
| 2,737,541 | 3/1956 | Coolidge | 204/20 |
| 3,020,327 | 2/1962 | Ruetschi | 136/120 |
| 3,061,525 | 10/1962 | Grazen | 204/16 |
| 3,116,170 | 12/1963 | Williams et al. | 136/86 |
| 3,124,520 | 3/1964 | Juda | 204/86 |
| 3,252,839 | 5/1966 | Langer et al. | 136/86 |
| 3,262,868 | 7/1966 | Juda | 204/98 |
| 3,281,996 | 11/1966 | Cuklanz | 204/16 |
| 3,287,169 | 11/1966 | Rogers | 136/86 |
| 3,407,125 | 10/1968 | Fehlner | 204/20 |
| 3,549,505 | 12/1970 | Hanusa | 204/11 |
| 3,597,822 | 8/1971 | Fehlner | 29/183.5 |
| 3,694,325 | 9/1972 | Katz et al. | 204/11 |
| 4,035,254 | 7/1977 | Gritzner | 204/98 |
| 4,035,255 | 7/1977 | Gritzner | 204/98 |

FOREIGN PATENT DOCUMENTS 1,199,404 7/1970 United Kingdom.

*Primary Examiner*—T. M. Tufariello
*Attorney, Agent, or Firm*—J. M. Kuszaj

[57] ABSTRACT

The invention relates to an improvement in an electrolytic cell having an anode positioned within an anode chamber and an oxidizing gas depolarized cathode positioned within a cathode chamber adapted to contain a catholyte, said cathode chamber spaced apart from the anode chamber by a cation-permeable partition. The improved cell comprises the cathode having a cellular metal structure comprising a continuous interconnected network of electrolytically deposited metal defining therebetween a plurality of substantially convex and substantially electrically nonconductive cellular compartments. The arrangement of the compartments is adapted to permit passage of the oxidizing gas to the catholyte. The cellular metal structure is further characterized in that the deposited metal interfaces the cellular compartments within the cellular metal structure.

16 Claims, No Drawings

ELECTROLYTIC CELL

CROSS REFERENCE TO RELATED APPLICATION

The application is a continuation-in-part of copending application Ser. No. 691,692, filed June 1, 1976 now U.S. Pat. No. 4,053,371.

BACKGROUND OF THE INVENTION

This invention pertains generally to an electrolytic cell and more particularly to an electrolytic cell containing an oxidizing gas depolarized cathode.

Various methods to conserve electrical power in electrolytic cells, especially those cells used for the production of alkali metal hydroxides, such as caustic soda and chlorine, have been developed. One method involves the use of porous cathodes in combination with an oxidizing gas to depolarize the electrode; see, for example, U.S. Pat. Nos. 2,681,884; 3,124,520; 4,035,254; and 4,035,255. It is desired to provide an improved electrolytic cell having an oxidizing gas depolarized cathode.

SUMMARY OF THE INVENTION

The present invention is an improvement in an electrolytic cell having an anode positioned within an anode chamber and an oxidizing gas depolarized cathode positioned within a cathode chamber adapted to contain a catholyte, said cathode chamber spaced apart from the anode chamber by a cation-permeable partition. The improved cell comprises the cathode having a cellular metal structure comprising a continuous interconnected network of electrolytically deposited metal defining therebetween a plurality of substantially convex and substantially electrolytically nonconductive cellular compartments. The compartments are adapted to permit passage of the oxidizing gas to the catholyte. The cellular metal structure is further characterized in that the deposited metal interfaces the cellular compartments within the cellular metal structure.

DESCRIPTION OF THE PREFERRED EMBODIMENT

The electrolytic cell of the present invention comprises an anode chamber suited to contain an anolyte such as an aqueous solution or mixture of an alkali metal salt, for example, sodium chloride. A cathode chamber, adapted to contain a catholyte such as the hydroxide of the alkali metal, is spaced apart from the anode chamber by a partition.

The partition separating the anode and cathode chambers is suited to pass cations of at least the alkali metal from the anode chamber to the cathode chamber. The partition is suitably positioned in the electrolytic cell to substantially entirely separate the anode chamber from the cathode chamber. Suitable partitions include diaphragms, such as the well-known drawn asbestos diaphragm, described in U.S. Pat. No. 4,035,255 and cation exchange membranes, such as those described in U.S. Pat. No. 4,035,254, which descriptions are incorporated herein by reference.

An anode is suitably positioned within the anode chamber and a cathode is suitably positioned within the cathode chamber to be spaced apart from the partition, that is, substantially all of the catholyte is contained within a space or opening at least partially defined by the partition and at least partially by an outer surface of the cathode.

The cathode is further adapted to have at least one wall portion in contact with the catholyte and at least one wall portion substantially simultaneously in contact with an oxidizing gas, for example, air, oxygen, or a molecular oxygen containing gas. The cathode is formed of a material, the structure of which is adapted to transmit or pass the oxidizing gas from a gas compartment to the catholyte. Preferably, formation of oxidizing gas bubbles on the outer surface of the cathode is minimized and more preferably the outer surface of the cathode is substantially free of oxidizing gas bubbles.

The cathode of the present invention is a cellular metal structure comprising a continuous interconnected network of electrolytically deposited metal. In one embodiment, at least one surface of the cellular metal structure is coated with polytetrafluoroethylene, polyhexafluoropropylene and other polyhalogenated ethylene or propylene derivatives.

Preferably, the electrolytic cell further includes means to circulate the catholyte at least within the cathode chamber and means to control the moisture content of the oxidizing gas in contact with the cathode.

A means to supply a direct current to the anode and the cathode is suitably electrically connected to these electrodes. The electrolytic cell further includes a means to remove the products, such as the chlorine produced in the anode chamber and means to remove the alkali metal hydroxide formed in the cathode chamber.

Examples of suitable electrolytic cells in which the present invention is useful, and a more detailed description of the construction and operation of such cells is contained in U.S. Pat. Nos. 4,035,254 and 4,035,255, which descriptions are incorporated herein by reference.

Various metals and alloys which are suitable for electrodeposition may be deposited to form the novel cellular metal depolarized cathode. For example, such metal and metal alloys include copper, silver, nickel, gold, platinum, palladium, rhodium, indium, and alloys of the above-mentioned metals. Palladium, platinum, and silver are the preferred electrolytically deposited metals.

The network of electrolytically deposited metal defines a plurality of substantially convex cellular compartments therebetween, such that the electrolytically deposited metal interfaces the cellular compartments within the cellular metal structure. In one embodiment, the electrolytically deposited metal defines a plurality of substantially spherical cellular compartments therebetween.

The network of electrolytically deposited metal occupies from about 1 to about 50 percent by volume of the cellular metal structure. In another embodiment the network of electrolytically deposited metal occupies from about 3 to about 40 percent by volume of the cellular metal structure.

At least a portion of the convex cellular compartments are at least partially filled with catholyte and at least partially with a substantially electrically nonconducting gaseous medium such as air, oxygen or a molecular oxygen containing gas. The diameter of the convex cellular compartments may vary with the intended use for the finished cellular metal product. However, a cellular metal structure having convex cellular compartments with a diameter of from about 0.10 to about 300 microns is suitable for use as an oxidizing gas depolarized cathode. A cellular metal structure wherein the convex cellular compartments have a diameter of from about 1 to about 50 microns is preferred for use as an oxidizing gas depolarized cathode.

The network of electrolytically deposited metal preferably defines a plurality of substantially convex cellular compartments arranged in an open cellular array. In other embodiments, the compartments can be arranged in a combination of open and closed cellular arrays. As used in this context, a closed cellular array is an array in which adjacent cellular compartments are not in contact, or contact each other only at a single point. Access from inside one compartment to an adjacent compartment is limited or nonexistent in a closed array. An open cellular array is an array in which adjacent cellular compartments have a considerable area of mutual interface. There is relatively free access from one compartment interior to another.

The convex cellular compartments are additionally arranged in a random close packed array, a random loose packed array, a random packed array intermediate in density between the random close packed and random loose packed arrays, or in the case of substantially spherical cellular compartments a regular close packed array. Random packing of an array to achieve maximum density is defined to be random close packing, while random packing to achieve minimum density is defined to be random loose packing. Hexagonal or face-centered cubic packing of an array is defined to be regular close packing.

A preferred process for electrolytically producing the cellular metal cathode structure comprises providing in an electrolytic metal deposition cell a cellular array of substantially convex and substantially electrically nonconductive particles having a plurality of interstitial spaces therebetween. More preferably, the particles are selected from the group consisting of organic polymeric beads, and inorganic polymeric beads such as glass beads, clay particles, sand particles and the like. Most preferably, the particles are substantially spherical organic polymeric beads, such as polystyrene beads.

The individual particles of the array can be arranged in an open cellular array, or in a combination of open and closed cellular arrays. Suitable methods for providing open cellular arrays include applying pressure, heat, or suitable solvents to a closed cellular array to convert point contacts between particles to surface interfaces.

The array is positioned between the anode and the cathode of a suitable electrolytic metal deposition cell so that at least a portion of the array is in contact with the cathode surface during electrodeposition.

The anode and cathode materials employed in the metal deposition cell are those generally known in the art to be useful as electrodes, for example, graphite, Ru, Rh, Pd, Ag, Os, Cu, Ir, Pt, Au, Ti, Al, W, Ta, Fe and the like. Optionally, the metal to be deposited may serve as the anode or the cathode.

The anode and cathode can be arranged in the electrolytic metal deposition cell in a variety of geometrics well-known in the art. For example, in one embodiment, the cathode is a flat planar sheet forming the bottom portion of a substantially cylindrical container, the side walls of which are insulating material, and the interior of which is packed with the cellular array. The anode is a flat spiral of wire adapted to fit within the cylindrical container near its top portion.

In another embodiment, the anode and cathode form a circular type metal deposition cell. In this geometry, the cathode is a central post surrounded by a cellular array held in a porous cylindrical container. Wire wound about the walls of the container forms the anode.

In addition to flat, planar cathodes and central post cathodes, any electrolytic metal deposition cell geometry that allows the cellular array to be held in close intimate contact with the cathode surface during electrodeposition can be suitably used in the present process.

The array is at least partially, and preferably completely, immersed in an aqueous solution of an electrolyte suitable for the electrolytic deposition of the metal to be deposited. Suitable electroltyes are well-known in the art for each electroplatable metal. For example, where the electroplatable metal is copper, an aqueous acid copper sulfate electrolyte can be used. If silver is to be electroplated, an aqueous basic silver cyanide electrolyte bath is suitable.

Preferably, prior to the introduction of the electrolyte the array of particles is contacted sequentially with sufficient amounts of a low surface tension wetting agent, such as methanol, at subatmospheric pressure and then sufficient amounts of water to remove occlued gases from the array. Pressures of from about 0.1 to 0.2 atmosphere have been found satisfactory for the methanol treatment.

Electrodeposition of the metal is achieved by the application of a direct current potential between the anode and cathode of the electrolytic metal deposition cell containing the cellular array. Since the array of particles is packed densely into the electrolyte space beteen electrodes, the applied current flows to deposit metal at the cathode/electrolyte interface. The deposition, however, is confined to the interstitial space between the particles of the array of particles. As a result, a continuous interconnected network of metal is deposited starting at the cathode surface bordering the array. The electrolyte/electrode interface or "front" advances progressively through the array toward the anode.

Following electrodeposition, at least a portion of the array of particles is removed from the metal network by subjecting an open cellular portion of the array to solvent extraction, pyrolysis, or other suitable techniques for removing the particles without removing the metal network.

Preferably, the surfaces of the substantially electrically nonconductive particles in the array have an electrical conductivity lower than the electrical conductivity of the electrolyte. More preferably, the particles in the array are electrically insulating particles.

The electrodeposition of the cellular metal forming process is preferably carried out at a temperature of from about 0° to about 95° C. More preferably, the electrodeposition is carried out from about 15° to about 35° C. at about atmospheric pressure.

Preferably, sufficient potential is applied between the anode and cathode of the metal deposition to produce a current density of from about 0.10 to about 20 amperes per square foot of cathode surface area. More preferably, sufficient potential is applied to produce a current density of from about 0.10 to about 10 amperes per square foot of cathode surface area.

The cellular metal product produced by the present process can be formed with the appropriate shape and compartment size to fit its intended end use.

The following examples are illustrative of the process of making the cellular metal structure of the present invention.

EXAMPLE 1

A circular type electrolytic metal deposition cell containing a centrally located cathode rod surrounded by packed beads and the anode, in a circular or cylindrical symmetric arrangement, was employed to produce a cellular copper structure.

The electrolytic metal deposition cell assembly contained a cathode rod ¼ inch in diameter and 6 inches in length. The cathode rod was 99.49 percent by weight copper, 0.50 percent by weight tellurium, and contained a trace amount of phosphorus. The cathode rod was cleaned to remove oxide coating with abrasive paper to a uniform bright color level and then stirred in $CH_3CCl_3$ solvent. The rod was subsequently immersed and stirred in a solution of 250 ml 0.1 normal (N) NaOH mixed with 1.25 grams (g) $Na_2CO_3$ for 20 to 30 minutes.

The cathode was inserted in the center of a cylindrical Alundum® round bottom thimble with an outside diameter of 26 millimeters (mm) and an outside height of 60 mm. The thimble material contained sintered aluminum oxide particles and formed a porous, electrically insulated and mechanically strong container. The pores of the thimble were of a size no greater than that sufficient to contain about −45 mesh (U.S. Standard) polystyrene beads, but were large enough to permit flow of electrolyte between an electrolyte reservoir and the interior of the thimble.

A helical coil, hand-wound from ⅛ inch outside diameter copper tubing, was placed around the outside wall of the thimble to form the anode. The central hole in the copper tubing was about 1/10 of the tube diameter, and the winding mandrel was a 1 5/16 inch diameter steel pipe. The copper tubing was cleaned with abrasive paper before winding, and treated with $CH_3CCl_3$ solvent and $NaOH/NaCO_3$ in substantially the same manner as the cathode.

Silicone rubber gaskets ⅛ inch in thickness, were adapted to fit around the cathode rod near the top and bottom ends of the rod. The washers were of sufficient diameter to fit in the barrel of the thimble and form a tight fit, especially at the bottom end of the cathode. The clearance between the upper washer and the lower washer was about 1⅜ inch.

The interior of the thimble was packed with substantially spherical beads. The beads were polystyrene with 4.0 percent by weight divinylbenzene and traces of isopentane. The beads passed through a U.S. Standard #45 sieve, but were caught on a U.S. Standard #50 sieve. The average size of the bead was about 330 microns. The beads were stirred with deionized water in a small beaker and then poured into the thimble with the cathode rod and the lower washer inserted in place. The beads were manually pressed down from above to pack the beads in the thimble space.

When sufficient beads were added to fill the thimble to about ⅛ inch from the top, the upper washer was added to the thimble.

The electrolyte contained 900 milliliter (ml) deionized water, 135.5 g of $CuSO_4.5H_2O$, 60 ml concentrated $H_2SO_4$ (density 1.84 grams per cubic centimeter (g/cc) and 110 mg gelatin powder. The electrolyte was placed in the interior of the thimble and in the electrolyte reservoir.

The electrolytic metal deposition cell circuitry contained a direct current power source, a 50 ohm resistor and a 0–20 ohm variable resistor connected in series between the power source and a 0–300 milliampere meter. A high impedance multirange voltmeter was connected between the cathode rod and the anode.

The cell was allowed to equilibrate for 1.5 hours, and then a direct current potential of 0.100 volts was applied across the cell and the current was adjusted to about 50 milliamperes. This level corresponded to about 4.8 amperes per square foot current density at the cathode rod surface. Copper metal was deposited at the cathode rod surface and the plating interface advanced through the packed beads toward the walls of the thimble.

When copper metal had substantially filled the available interstitial spaces between the beads within a ⅜ inch radius of the cathode rod, the cell was disconnected and the cellular copper structure was removed.

The product was a cellular copper structure comprising a continuous network of electrolytically deposited copper defining a plurality of substantially spherical compartments containing polystyrene therebetween. The rod may be removed from the cellular metal by suitable means well-known in the art. The lightweight cellular metal product formed is of sufficient strength to withstand aluminum machining speeds without cracking. The polystyrene may be removed from the compartments, and the cellular copper structure utilized as an oxidizing gas depolarized cathode.

EXAMPLE 2

An electrolytic metal deposition cell with a geometry resembling a hollow cylinder was employed to produce a cellular silver structure.

The cell contained a 2 inch diameter disk-shaped hole in a thick (⅛ inch) silastic rubber sheet. A flat silver sheet bordered the cell region at the bottom and served as the cathode. The sheet was 4 inches square and 0.005 inch thick. It was cleaned substantially as described for the cathode in Example 1.

The silastic rubber sheet containing the disk-shaped hole was bordered on the top by a perforated polypropylene disk ⅛ inch thick. A 2 inch diameter glass tube for containing the electrolyte was placed over the perforated disk. The glass tubing was 1½ inch in height and about 0.2 inch thick.

Spherical polystyrene beads with diameters in the 10 to 20 micron range were sintered together by compression molding at about 95° C. to form a bead sinter that resembled a disk. The bead sinter had about 30 percent by volume void space.

The sintered beads were then placed in the disk-shaped hole in the silastic rubber sheet. The glass walled tube section was placed atop the silastic rubber sheet, enclosing the cell content.

After cell assembly, 70 ml of methanol were introduced into the cell to fill the glass tube reservoir and immerse the sintered beads. The pressure around the assembly was reduced to about 0.1 atmosphere. After about 10 minutes the methanol was drained and replaced with 70 ml of deionized water. After 2 hours the water was drained from the reservoir and replaced with electrolyte. Loading in this way eliminated gas bubbles between beads, while allowing the cell to be filled with relatively high surface tension electrolyte.

Liquid electrolyte was introduced into the glass tube. The electrolyte contained 90 g/l silver cyanide, 112.5 g/l potassium cyanide, 15 g/l potassium carbonate, 15 g/l potassium hydroxide, 0.04 cc/l of 60% solution of ammonium thiosulfate, and 1000 ml deionized water.

A silver wire helically wound circular anode with a ⅛ inch outside helix diameter was introduced into the electrolyte at the top region of the glass tube container.

The metal deposition cell circuitry was substantially as described in Example 1.

The metal deposition cell was operated at a voltage starting at 0.062 volts and ending at 0.142 volts. The amperes per square foot of cathode surface area was maintained at 0.55. A cellular silver structure with sintered spherical beads of polystyrene surrounded by electrolytically deposited silver was produced.

After the cellular silver structure was removed from the cell, the structure was stirred for 2 hours in toluene to dissolve the polystyrene. The final product was a 1 inch diameter by 8 mils thick disk-shaped porous silver structure with 29.8 percent solid silver and 70.2 percent voids. The porous silver structure can be utilized as an oxidizing gas depolarized cathode.

EXAMPLE 3

An electrolytical cell substantially as shown in U.S. Pat. No. 4,325,255 (FIG. 2) with a well-known drawn asbestos diaphragm, a graphite anode, and a 3½ inch × 3½ inch cellular silver depolarized cathode is used to produce chlorine gas at the anode and sodium hydroxide in the cathode compartment.

The cellular silver depolarized cathode is an 8 mils thick porous silver structure having about 29.8 percent solid silver and about 70.2 percent voids produced substantially as described in Example 2.

Prior to installation in the electrolytical cell, the cellular silver cathode structure is heated, within a temperature range of from about 100° C. to about 120° C. Sufficient du Pont Teflon 30B latex (diluted one part latex to 8 parts water) is sprayed on a single surface of the cellular silver to form a coating of about 2 to about 10 milligrams Teflon per square centimeter of surface. The cellular silver structure is then heated for about 2 minutes at about 350° to 360° C. in a nitrogen atmosphere. The sprayed Telfon surface is positioned in the cell to form a wall portion of a depolarized gas compartment.

The cell is operated using an electrode area of 3.14 square inches of each of the anode and the cathode. The spacing between the anode and cathode is 11/16 inch. An aqueous brine containing about 300 grams per liter sodium chloride is continuously fed into the anode chamber and a sodium hydroxide containing cell effluent is removed from the cathode chamber.

Operation of the cell is carried out in a manner known to those skilled in the art, with the exception that either oxygen, air, or a molecular oxygen containing gas is pumped through the gas compartment during operation. The cell voltage is significantly reduced when the cathode is an oxidizing gas depolarized cathode in accordance with the present invention.

What is claimed is:

1. In an electrolytic cell having an anode positioned within an anode chamber and an oxidizing gas depolarized cathode positioned within a cathode chamber adapted to contain a catholyte, said cathode chamber spaced apart from the anode chamber by a cation-permeable partition, the improved cell comprising the cathode having a cellular metal structure comprising a continuous interconnected network of electrolytically deposited metal defining therebetween a plurality of substantially convex and substantially electrically non-conductive cellular compartments adapted to permit passage of the oxidizing gas to the catholyte, said cellular metal structure further characterized in that the deposited metal interfaces the cellular compartments within the cellular metal structure.

2. The improved cell of claim 1 wherein the electrolytically deposited metal is selected from the group consisting of copper, silver, palladium, platinum, nickel, gold, rhodium, indium and alloys thereof.

3. The improved cell of claim 1 wherein the electrolytically deposited metal is silver.

4. The improved cell of claim 1 wherein the electrolytically deposited metal is palladium.

5. The improved cell of claim 1 wherein the electrolytically deposited metal is platinum.

6. The improved cell of claim 1 wherein the electrolytically deposited metal defines a plurality of substantially convex cellular compartments arranged in an open cellular array.

7. The improved cell of claim 1 wherein at least a portion of the convex cellular compartments are at least partially filled with catholyte and at least partially filled with a gaseous medium.

8. The improved cell of claim 7 wherein the gas contains molecular oxygen.

9. The improved cell of claim 1 wherein the electrically deposited metal occupies from about 1 to about 50 percent by volume of the cellular metal structure.

10. The improved cell of claim 1 wherein the electrically deposited metal occupies from about 3 to about 40 percent by volume of the cellular metal structure.

11. The improved cell of claim 1 wherein the cellular compartments have a diameter of from about 0.1 to about 300 microns.

12. The improved cell of claim 1 wherein the cellular compartments have a diameter of from about 1 to about 50 microns.

13. The improved cell of claim 1 wherein the cation-permeable partition is a diaphragm.

14. The improved cell of claim 13 wherein the diaphragm is asbestos.

15. The improved cell of claim 1 wherein the cation-permeable partition is an ion exchange membrane.

16. The improved cell of claim 1 wherein the cell is adapted to produce chlorine.

* * * * *